United States Patent [19]

Stahlkopf

[11] Patent Number: 4,492,535

[45] Date of Patent: Jan. 8, 1985

[54] DIAPHRAGM PUMP

[75] Inventor: Friedrich R. R. Stahlkopf, Büchen, Fed. Rep. of Germany

[73] Assignee: Otto Tuchenhagen GmbH & Co. KG, Büchen, Fed. Rep. of Germany

[21] Appl. No.: 575,490

[22] Filed: Feb. 1, 1984

Related U.S. Application Data

[63] Continuation of Ser. No. 263,745, May 14, 1981, abandoned.

[30] Foreign Application Priority Data

May 31, 1980 [DE] Fed. Rep. of Germany ..... 3020775

[51] Int. Cl.[3] ..... F04B 43/08

[52] U.S. Cl. ..... 417/394; 92/92

[58] Field of Search ..... 417/383, 394, 478; 92/90, 91, 92

[56] References Cited

U.S. PATENT DOCUMENTS

| | | | |
|---|---|---|---|
| 313,383 | 3/1805 | Booth | 417/383 |
| 1,832,259 | 11/1931 | Stephens . | |
| 2,092,629 | 9/1937 | Allen . | |
| 2,105,067 | 1/1938 | Allen | 417/383 |
| 3,007,416 | 11/1961 | Childs | 417/383 |
| 3,062,153 | 11/1962 | Losey . | |
| 3,335,666 | 8/1967 | Czarnecki | 417/394 X |

FOREIGN PATENT DOCUMENTS

| | | |
|---|---|---|
| 288870 | 3/1971 | Austria . |
| 1911525 | 10/1969 | Fed. Rep. of Germany . |
| 1653577 | 3/1971 | Fed. Rep. of Germany . |

*Primary Examiner*—Leonard E. Smith

*Attorney, Agent, or Firm*—Lane, Aitken & Kananen

[57] ABSTRACT

A diaphragm pump especially for pumping viscous and abrasive materials including a spherical housing, the inner portion of which defines a pumping chamber together with a cylindrical hose membrane activated by a pulsating medium. One or more hose membranes surround a support pipe having a circular cross section to prevent compressive strain on the membranes during pumping by deformation of the membrane in the inward direction. In an alternative embodiment, a modulated support tube is provided to permit the diaphragm to flap into the indentations of the support tube in a manner neutral to longitudinal extension. Support rings are provided which permit symmetrical arching of the hose diaphragm during the compression stroke.

22 Claims, 9 Drawing Figures

FIG. 2a.
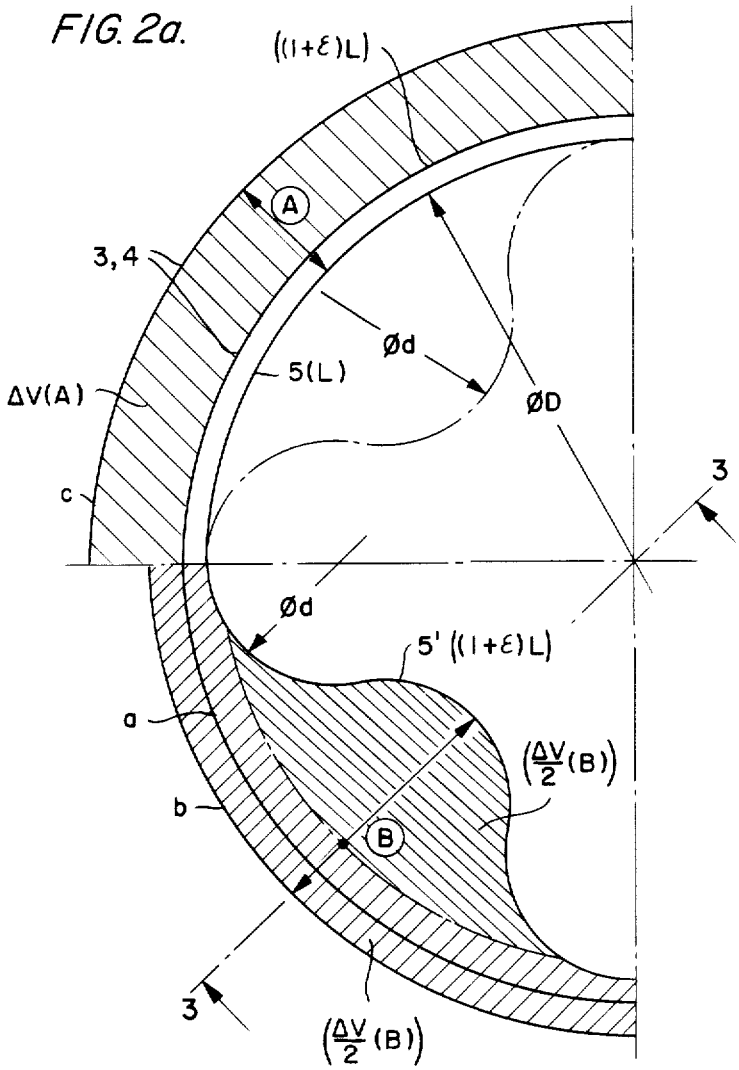
FIG. 2b.
FIG. 3.
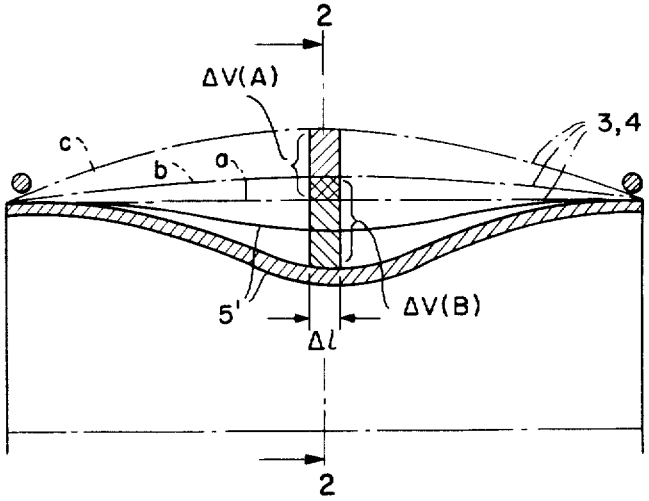

DIAPHRAGM PUMP

This application is a continuation of application Ser. No. 263,745, filed May 14, 1981, now abandoned.

BACKGROUND OF THE INVENTION

The invention relates to a diaphragm pump, designed as a hydraulically activated reciprocating pump, especially for the pumping of a viscous and abrasive medium or for one which is a secondary flowable medium charged with solid materials, and having a pump section through which the secondary medium flows. The pump section is insertable as an integrated part of a pipe line for the secondary medium to be delivered, and has a return valve at the suction as well as the pressure side. An operational portion designed as a separate unit is coupled with the pump section by means of a connecting fitting carrying a primary flowable operational medium. The primary operational medium affecting the inside of a tubular membrane is made of elastomer material, having the shape of a cylindrical hose. The pump operates the membrane by means of pulsating pressure, while the secondary medium is located in the pump chamber surrounding the membrane.

Diaphragm pumps of the initially described type are known from U.S. Pat. Nos. 1,832,259 and 2,092,629, in which the diaphragms in the shape of a cylindrical hose are tensioned into essentially cylindrical housings with their respective ends. These diaphragm pumps, because of their specific geometric relations between a tube membrane and a cylindrical housing, are not suited for the delivery of media carrying more or less granular solid matter, since the latter, not being able to divert, are driven into the surface of the hose, especially within the relatively narrow pump chamber, within the area of the tensioned clamping of the tubular membrane.

Thus, the disclosed state of the art indicates that, while the mode of operation of the known diaphragm pumps in principle corresponds to that of the initially described type, the constructive design of the pumps of record does not permit the delivery of heavy, viscous and abrasive fluids as well as of fluids charged with solid matter.

Austrian Pat. No. 288 870 describes a hose pump for dense viscous matter, for concrete or bulk materials in which the operating medium and the material to be delivered are separated by an elastic hose, the liquid or gaseous operating medium being within said hose, and the material to be delivered being between said hose and the surrounding pump housing, within thus formed annular space. This hose pump which has no valves is characterized by being sub-divided into at least three subsequently arranged chambers in which elastic tubes are arranged by means of concentric inner bodies, the hoses at their ends being fastened and sealed to the said inner bodies, their middle parts being pressed against the chamber walls by way of chamber connections and the introduction of operating media flowing within the inner bodies, and which, being relieved of pressure and contracting by their own elasticity, come to rest against the inner body once more. In this hose pump of record, each of the hose membranes temporarily performs the functions of the lacking return valves, cooperating with the surrounding cylindrical housing wall. Should a pump of this type be used for the delivery of media containing coarse solid matter, the danger arises during the phase where the hose membrane is pressed against the surrounding cylindrical housing wall, that individual solid particles, unable to be diverted, will be driven into the hose surface and will destroy it in due time.

Another solution of the task with regard to the medium to be delivered as well as from the viewpoint of sufficient longevity is achieved by another diaphragm pump, characterized by the use of a sheet diaphragm in place of a tubular elastomer membrane. The known standard designs hardly present problems regarding the delivery of media which are charged with solid matter, nor are there any problems with longevity, inasmuch as sheet diaphragms are merely vaulted and thus come under tensile stress. Lately, the need for, and the application of, diaghragm pumps, especially in the area of environmental protection, has been increased, requiring these pumps to handle densely viscous and abrasive media or such media which are charged with solid materials. At the same time, these pumps are required to be not only more efficient but also more economical than the past designs. The requirements of higher efficiency require for all known designs an increase in the dimensions of the diaphragm housing. It is true that diaphragm pumps with sheet membranes may be increased in size without any problems. This, however, results in considerable wall thicknesses for these usually short, cylindrical pump housings with large diameters, in particular in the area of the circular covers. Thus, for instance, the cover wall thickness of a gray cast iron housing with a diameter of 500–600 mm, is 20 mm and more. Given these dimensions, the demands for a diaphragm pump which is equally efficient as it is economical can no longer be met.

Basic considerations have shown that the demands of the market for a well-priced diaphragm pump with high efficiency and high delivery pressure may be met with the aid of pumps of the initially described type if it is possible to design this type of pump in such a manner that densely viscous and abrasive, as well as media abrasive loaded with solid materials, may be delivered. It was the finding of the aforementioned considerations dealing with pump behaviour that, given approximately identical outer dimensions for the pump housing, hose membrane pumps, with a hose membrane affected by the operating medium from the inner side, deliver about double the suction volume than the diaphragm pump with a sheet membrane, having assumed a condition that the required membrane displacements during the pressure lift would be about identical. The kinematic reversal of a pump design, deemed especially advantageous, and leading to a pump in which the hose membrane is compressed from the outside by the operating medium, is not suitable because, first, the elastomer materials in use at the present time are susceptible to strain and, second, maximum efficiency of delivery can be obtained only with an inflated, distended hose and not with one which is compressed.

It is the purpose of the present invention to design the diaphragm pump of the initially described type in such a manner that the greatest possible suction volumes or delivery flows and delivery pressures, respectively, can be obtained coupled with a lowest possible weight or, respectively, the smallest possible dimensions. In doing so, the extension of the hose membrane required for the realization of a given lift volume is to be reduced to the lowest possible value. The requirement of maximum efficiency with a minimum of constructive expenditure should, in addition, apply also to all other peripheral units of the pump aggregate, resulting in a minimizing of costs.

This purpose is achieved by surrounding the pump chamber by an outer, preferably spherical housing and the outer surface of the hose membrane which, with its both ends is stretched and clamped within the housing.

The design of the pump chamber according to the invention makes it possible to fabricate the housing, which, ideally, should be ball-shaped, as a steel plate construction. It is a known fact that spherical housings provide the greatest possible stability with the lowest possible material consumption. In addition, the spherical housing permits the use of a hose membrane with a large diameter which results in the greatest possible lift volume. The clamping of the membrane at its both sides within the spherical housing furthermore is of great advantage, inasmuch as the spherical housing may be opened by lifting a cover without the hose membrane having to be dismantled at the same time. The spherical housing in addition makes sure that at the point of the greatest distension of the membrane, the greatest clearance of the spherical housing is available. This prevents an attachment of the hose membrane to the wall of the spherical housing while, at the same time, achieving the advantage that the suction as well as the pressure muff arranged in this area are freely accessible to the medium to be delivered. In order to prevent a membrane rupture and, as a consequence, damage to the operating part especially by abrasive media, two cylindrical hose membranes are provided, the outer membrane concentrically sheathing the inner one without interstices. This arrangement of two hose membranes sheathing each other is known from the aforementioned U.S. patents, where, however, they are arranged in essentially cylindrical housings.

Additional basic considerations as were referred to above, gave the result that, given approximately identical outer dimensions for the pump housing, the hose membrane pump gave about double the volumetric suction yield of a comparable diaphragm pump with a sheet membrane. These excellent results regarding the suction volume are countered by an essentially greater maximum surface extension of the material of the hose membrane. Thus, for instance, a hose membrane giving the double volume lift of a sheet membrane, will be stretched three times as much in the area of its maximum distension than the sheet membrane in the area of its respective greatest stress. The surface extension of the aforementioned hose membrane still remains about double that of the surface extension of the sheet membrane even if the excursion of the hose membrane is reduced to a point where the lift volume is only half, i.e. where it is adapted to the lift volume of the unchanged excursion of the sheet membrane. These grave differences can be proven mathematically. As can be easily determined, the circumferential extension of the hose membrane is in direct proportion to its radial excursion, while the corresponding arching of the sheet membrane, from a mathematical viewpoint, does not react as strongly to the relations for the uniaxial stretching of the arched sheet membrane. Supporting papers indicate that it is not the occurring surface stretch which would influence any judgement of tolerable stretches of a membrane material, but the longitudinal, linear stretch deduced as an equivalent. This equivalent linear stretch is approximately twice as great as the actually occurring surface stretch and is utilized as a dimensioning criterion when deciding on the size of the membrane. While it is true that modern membrane materials, the so-called elastomer vulcanized materials, are substantially resistant to breakage in extension, these values cannot be utilized when dimensioning the membrane. In practical use, linear distensions of more than 25% should possibly be avoided since, with an increased extension, the danger of permanent deformation cannot be excluded. As a rule, this value is reached nearly all the time by sheet membranes, while hose membranes in pumps according to the invention nearly always exceed it considerably in nearly every comparable application. The manufacturers of membrane material are not yet in a position of giving quantitative information regarding the residual extension of the possible materials, given the aforementioned considerable linear extensions, but experience has shown that the resulting permanent stretch cannot be neglected. As an example, this may have as a consequence that, after a certain load alternation, the permanently stretched hose membrane, following the pressure lift, no longer rests against the support pipe over its entire surface, because of its elastic contraction but that it is subject to life-shortening stress and is pressed against the support pipe during the suction lift while forming folds and creases.

BRIEF SUMMARY OF THE INVENTION

An advantageous development of the diaphragm pump according to the invention permits the realization of a necessary lift volume which, thus far, has extended and stretched the hose membrane after a certain load alternation, causing a considerably lessened extension.

This is achieved by effecting the pumping action of the hose membrane or the hose membranes, respectively, by a change in their shape and a change in their formation on a modified support pipe deviating from the circle. Here, the modified support pipe in each cross section vertical to the axis has several steadily formed indentations which preferably are evenly distributed over the circumference, deepening increasingly from the support pipe ends toward the longitudinal center, relative to the ability to change shape which is neutral to extension. The indentations are designed in such a way that the circumferential contour of the modified support pipe at any observed point is exactly as great as the circumferential length of the originally circular, unmodified support pipe. Therefore, the pump volume of a hose unit of a determined length consists of two parts, one part resulting from the change in shape, and an additional one resulting from the change of the shape of the hose membrane on the support pipe. The "change in shape" is to be understood as being the even, radially directed, concentric distension of the hose membrane around the support pipe. The mechanism of the pumping effect from the change shape of the hose membrane alone is known from U.S. Pat. No. 3,062,153. The mechanism of an alteration of shape indicates a deformation of the hose membrane which is neutral to linear extension as opposed to a circular initial position in the system which is not under pressure. The hose membrane, without changing the length of its circumference at that particular point, enters, like a flap, the interior area of the support pipe.

It is necessary, for this purpose, that the support pipe have indentations which are preferably evenly distributed around its circumference. Since this causes the initial position of the hose membrane to be located further radially inward at the beginning of the pressure lift, the membrane does not have to be stretched to an extent as would be required without the flap effect in order to achieve a given lift volume. When utilizing the "flap effect" which is neutral to linear extension of the hose membrane to deliver a certain volume, two possibilities must be distinguished:

1. The hose membrane is mounted on the modified support pipe without slackness. To the extent that, during its lifetime, the permanently stretched hose membrane increases the length of its circumference, by flapping into the indentations of the support pipe, it can profit from the volume delivery by the flap effect which is neutral to linear extension. The maximum extension of the hose membrane is reduced to the same degree as the permanent extension increases and the indentations of the support pipe being increasingly utilized.

2. The hose membrane is mounted on the modified support pipe with sufficient slack. Beginning with the first lift, this radial play has the effect of a permanent hose membrane extension and can contribute, by the flap effect which is neutral to linear extension within the indentations of the support pipe, to the volume yield. The hose membrane is stretched less tight from the beginning of delivery operations, which, in any case, will extend its life.

It is understood that the flap effect which is neutral to linear extension of the hose membrane can contribute to the increased efficiency of the pump unit whenever the aspects of longevity within a definite pump project play a subordinate role.

In this connection, it should be mentioned that the manufacture of the modified support pipe may be effected by reshaping. Under the invention, the length of the circumferential contour of the modified support pipe at each observed point is exactly as great as the circumferential length of the originally circular, not modified support pipe. The reshaping process from the circular support pipe to the modified support pipe thus does not result in any folds or warps.

According to an additional advantageous development of the diaphragm pump of the invention, the length of the circumference of the modified support pipe in each cross-section, vertical to the axis, is identical to or greater than the necessary length of the circumference of the hose membrane immediately surrounding the support pipe, and it is so at all times.

By this coordination of the relation of the circumferential lengths of the hose membrane and the circumferential contour of the modified support pipe, it is ascertained at all times during the life of the membrane that any life-shortening stress of the hose membrane during the suction phase is avoided. With regard to a new diaphragm pump which has not yet begun operating, this means that the hose membrane is mounted on the modified support pipe with slack and that during the initial phase of operation any filling (neutral to linear stretch) of the indentations of the support pipe will be incomplete.

According to another additional advantageous embodiment of the diaphragm pump of the invention, the outer contour of the modified support pipe in each cross section, vertical to the axis, consists of circular arcs, equal in size and, relative to the axis of the support pipe alternatingly convex and concave, having a common tangent and a diameter d.

This embodiment of the modified support pipe is also quite easily manufactured and it ascertains a homogenous deformation of the hose membrane across the entire circumference of the support pipe.

An additional preferred embodiment of the diaphragm pump of the invention is characterized in that the inner and the outer hose membranes are commonly held at their rear end and the inner hose membrane at its front end is being held in a positive lock between a rear acceptance ring or, respectively, a cover at the outer side and a split or radially extensible intermediate ring at the outer side with a conical clamping ring, axially displaceable towards the center of the spherical housing radially widening an intermediate ring.

This particular embodiment permits the clamping area at the ends of the hose membrane to be made relatively short, so that relatively little of the installed hose membrane is lost for the attachment. The radial widening of the intermediate rings by conical tension rings which are axially displaced in opposite directions towards the center of the spherical housing is as simple as it is effective.

According to another preferred embodiment of the diaphragm pump of the invention, a support ring and the intermediate ring are arranged in an axial distance from each other which is larger by a multiple than the wall thickness of the hose membrane, in order to separate the clamping zone of the hose membrane from its flexing zone and to largely avoid multi-axial situations of tension which would tend to shorten the life of the membrane.

In an additional preferred embodiment of the diaphragm pump of the invention the axial displacement of the conical tension rings is effected by tension rods which are under tensile stress exclusively, their adjusting motion being affected from outside the pump and under any operating condition. This makes it possible, for instance, to retighten the hose membrane during operation of the pump.

Still another preferred embodiment of the diaphragm pump of the invention is provided with a cover tab which splits the ends of the hose membrane and connects a leakage opening at the extreme outer end of the cover tab with a triangular gap in the ring between an inner and an outer hose membrane with a threaded opening.

This so-called leakage control device permits timely detection of a ruptured membrane and will permit to a pump stoppage and replacement of the defective hose membrane.

Another preferred embodiment of the invention is characterized by four spherical housings each containing one hose membrane or two hose membranes, sheathing each other, being clamped at both of their ends and forming a pump unit, the housings being in a nearly stellar arrangement in a horizontal plane, relative to the axis of the hose membrane, two each being alternatingly affected by one of the two doubly acting operating units, feeding the primary operating medium. This solution combines four spherical housings containing cylindrical hose membranes to form an efficient and compact pump unit, the stellar arrangement of the individual spherical housings in one plane providing extremely short connecting paths from the spherical housings to the two operating units. The same applies for the connecting path between the connecting fitting and the loss and regain valve arranged for the operating medium and located within the storage container. The proposed solution also makes it possible to keep the storage tank for the operating liquid relatively small in size and to immediately superimpose it on the connecting fittings.

Another development of the invention achieves a simplification and cost-effectiveness of the entire safety system and does not demand any concessions when it comes to safety technology. This preferred development is characterized by each one of four connecting fittings by [illegible] of a separate safety line ending with an automatic vai[illegible]ing connected with a collecting tank formed by a collecting bell and a floor of a storage container, the collecting tank having one single safety valve.

In known multi-cylinder pump units, it is customary that each pump housing be provided with its own safety valve. Reduction to one single safety valve not only reduces the costs considerably but it also reduces the maintenance costs necessary for safety valves. The proposed solution also achieves, by the stellar arrangement of the pump housings, that the individual connecting fittings are arranged within a minimal space so that the individual safety lines can be kept relatively short and can be combined in a collecting bell. While the proposed solution will require four return valves, the cost of servicing and maintaining four return valves is essentially lower than that of the three safety valves saved.

An embodiment of a complete spherical housing of the invention and a diaphragm pump with four spherical housings as proposed by the invention are shown in the drawing and their structure and operation is described in detail as follows:

BRIEF DESCRIPTION OF THE DRAWINGS

FIG. 2*a* shows a partial cross sectional view through the support pipe taken along the lines 2—2 indicated in FIG. 3;

FIG. 2*b* shows a partial cross sectional view through the modified support pipe taken along the line 2—2 indicated in FIG. 3;

FIG. 3 illustrates a longitudinal sectional view through the modified support pipe taken along line 3—3 of FIG. 2*b*;

DESCRIPTION OF THE PREFERRED EMBODIMENTS

Figure 1:
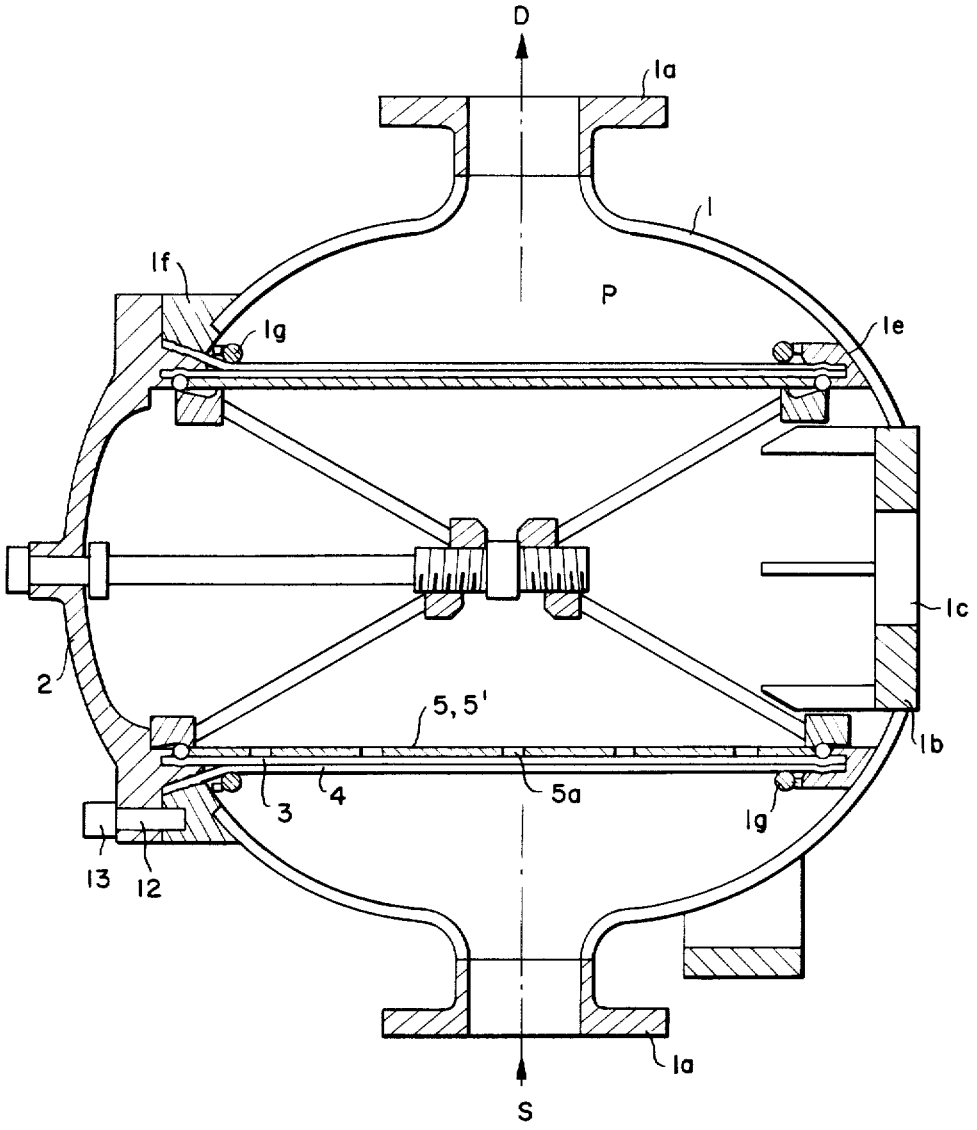
FIG. 1 shows a central cross sectional view of the pump of the invention, taken through the spherical housing.

The spherical housing 1 shown in FIG. 1 is executed in a welded construction. It is divided along a plane at right angles to the plane of the drawing and through which run the axes of symmetry of suction and pressure muffs S, D. Suction and pressure muffs S,D are formed by welding neck flanges 1*a*, immediately welded to a neck of the spherical housing 1. The spherical half shown at the left in this drawing has a circular opening ringed by an annular housing flange 1*f* and accepting several connection means 12, distributed over the circumference of the housing. The cover 2 is centered on the housing flange 1*f* and, in connection with the connecting means of the housing 12, is fastened by way of the connection means 13 which are part of the cover. The spherical half shown at the right hand side of the drawing also has a circular opening into which the disc-shaped connecting flange 1*b*, having a centered opening 1*c*, is welded. The lines of symmetry of the cover 2 and connecting flange 1*b* coincide with the horizontal line of symmetry of the spherical housing 1. The inside of the spherical housing 1 contains the inner and the outer hose membranes 3,4, said membranes sheathing each other, and a support pipe 5, having a circular cross section, arranged at the inside of the inner hose membrane 3. The latter is provided with a multitude of preferably cylindrical openings 5*a* whose total cross section is identical to or greater than the clear cross section of the passage opening 1*c*. The place of the support pipe 5 as shown in the drawing may be taken by a modified support pipe 5' which is described in detail in connection with FIGS. 2*a* to 3. The pump chamber P which accepts the medium to be delivered and through which the said medium flows is defined by the inner surface of the spherical housing 1 and the outer surface of the hose membrane 4. The right hand half of the spherical housing contains the rear holding ring 1*e* into which the right hand ends of the hose membranes 3,4 are clamped. The lefthand end of the outer hose membrane 4 is clamped between the cover 2 and the housing flange 1*f*, while the left-hand end of the inner hose membrane 3 is fastened in the cover 2 by means of a clamping device more closely described in connection with FIG. 4. Support rings 1*g*, symmetrically arranged in relation to the horizontal axis of symmetry of the spherical housing 1, arranged at a certain distance from the clamping point of the hose membranes, limit the arching area of the hose membrane. Additional details of this construction are described in connection with detailed drawings 4, 4*a* and 5.

The pulsating pressure of the primary medium entering through the opening 1*c* into the support pipe 5 causes the hose membranes 3,4 to elastically distend between the support ring 1*g* into the direction of the housing wall. The arching takes place symmetrically between the support rings 1*g* and has its greatest excursion in the center. Corresponding to the pressure drop in the primary medium, the hose membranes 3,4 contract under the influence of their own elasticity and finally rest again on the support pipe 5. In this manner, the volume of the pump chamber is alternatingly decreased and increased, so that the medium to be delivered may be suctioned through the suction muff S and may also be expelled through the pressure muff D. The support pipe 5 is perforated by a multitude of preferably cylindral openings 5*a* and does not cause any essential pressure loss in the primary operating medium.

FIG. 2*a* is a schematic sketch arranged above the horizontal line drawn in dash and dots. Of the sketched cross section of the support pipe 5, only a circle segment is shown. Those membranes 3,4 are attached to the support pipe 5, having a circumference L. It is to be assumed for the moment that the hose membranes 3,4 in a new pump are attached to the support pipe 5 without slack. After a certain load alternation, the hose membranes 3,4, because of events heretofore described, will experience a permanent circumferential stretch $\epsilon$, resulting in a circumference of $(1+\epsilon)L$. This condition is depicted in FIG. 2*a*. In order to realize a certain lift volume $\Delta V$ (A) a certain maximum excursion e of the hose membranes 3,4 is required, as shown. The lift volume Δ V (A) (shown shaded in the drawing), however, will be obtained only if during the suction lift the hose membranes 3,4 will be strained so that they will come to rest against the support pipe 5, having a diameter D. Inasmuch as it appears imperative, for reasons of simplified mounting, to install the hose membrane 3,4 with some slack on the support pipe 5, the disadvantages, even with a new pump, must be tolerated. The volumetric yield shown in FIG. 2*a* as a pump variation A is obtained exclusively by a change in shape, i.e. by a circular concentric distension of the elastic hose membrane around the circular support pipe.

FIG. 2*b* shows a pump variation B in which the volumetric yield of the hose membranes 3,4 is based on two pump mechanisms. One of these pump mechanisms has already been described in connection with pump variation A. It results from the change in shape of the hose membranes 3,4, namely their extension around the support pipe. In this process, the hose membranes 3,4 experience a maximum excursion identified by a final position b. Position a shows, as an example, just as in FIG. 2*a*, the tension free installation position of hose membranes 3,4 within a new pump. If the support pipe 5 is modified, as suggested by the invention, for instance by indentations in the shape or circular arches (support pipe contour 5'), the hose membranes 3,4 during the suction lift of the primary operating medium will adapt by radial folding to the modified circumferential contour 5' of the support pipe. This flap will be neutral to linear extension if care is taken that the circumferential length of the tension-free installation position a, or, respectively, the circumferential length of the permanently stretched hose membrane $(1+\epsilon)L$ can be received by a circumferential contour of equal length of the modified support pipe 5'. Those areas in FIG. 2*b* which are hatched in opposite directions represent about equal volume shares $\Delta V/2(B)$. It shows, on the other hand, that, given the dimensions as chosen, the aforedescribed "flap effect" which is neutral to linear extension, contributes considerably to the volumetric yield. The pump mechanism described in the second place results from the change in the shape of hose membranes 3,4. In summarizing, it may be stated that with the utilization of the flap effect, neutral to linear extension, for the purpose of increasing the volumetric yield, the hose membranes come under reduced tensile stress right from the start (maximum excursion b). If, however, the hose membranes 3,4 are mounted onto the modified support pipe 5' without slack, the folding of the said membranes into the preferably circular indentations of the support pipe 5' are not neutral to linear extension. With an increasing extension Δ, the hose membranes 3,4 flap into the support pipe 5' free of tension. Several additional variants are possible, but they will not be described here at this time. Thus, it is imaginable, for instance, that the circumference of the not yet permanently stretched hose membranes 3,4 be smaller than the circumferential contour of the modified support pipe 5' and that, at the beginning of the operation of the diaphragm pump one has to do without a complete flapping of the hose membranes into the modified support pipe 5'. This may be achieved, for instance, by a corresponding regulation of the partial vacuum during the suction lift. As soon as the material ages and the resulting permanent extension $\epsilon$ of the hose membranes 3,4 exists, the flapping effect is made use of more and more, so that, given a predetermined constant yield, the aging hose membranes 3,4 must be extended much less. This can lead to a longer life for the membranes.

FIG. 3 shows a longitudinal section through the modified support pipe 5' along the line 3—3 indicated in FIG. 2*b*. The lift volume of a hose element Δ 1 for the pump variant A is shown between membrane positions a and c. Membrane position a is the installed position, free of tension and membrane position c is the maximum excursion of hose membranes 3,4 caused by a change in shape. An identically large lift volume Δ V(B) of the same hose element Δ 1 is achieved if the volumetric yield is effected by a change in shape and by an alteration of shape of the hose membranes 3,4. In doing so, the hose membranes 3,4 move between the modified support pipe 5' and the membrane position b which is located somewhere between membrane positions a and c.

Figure 4:
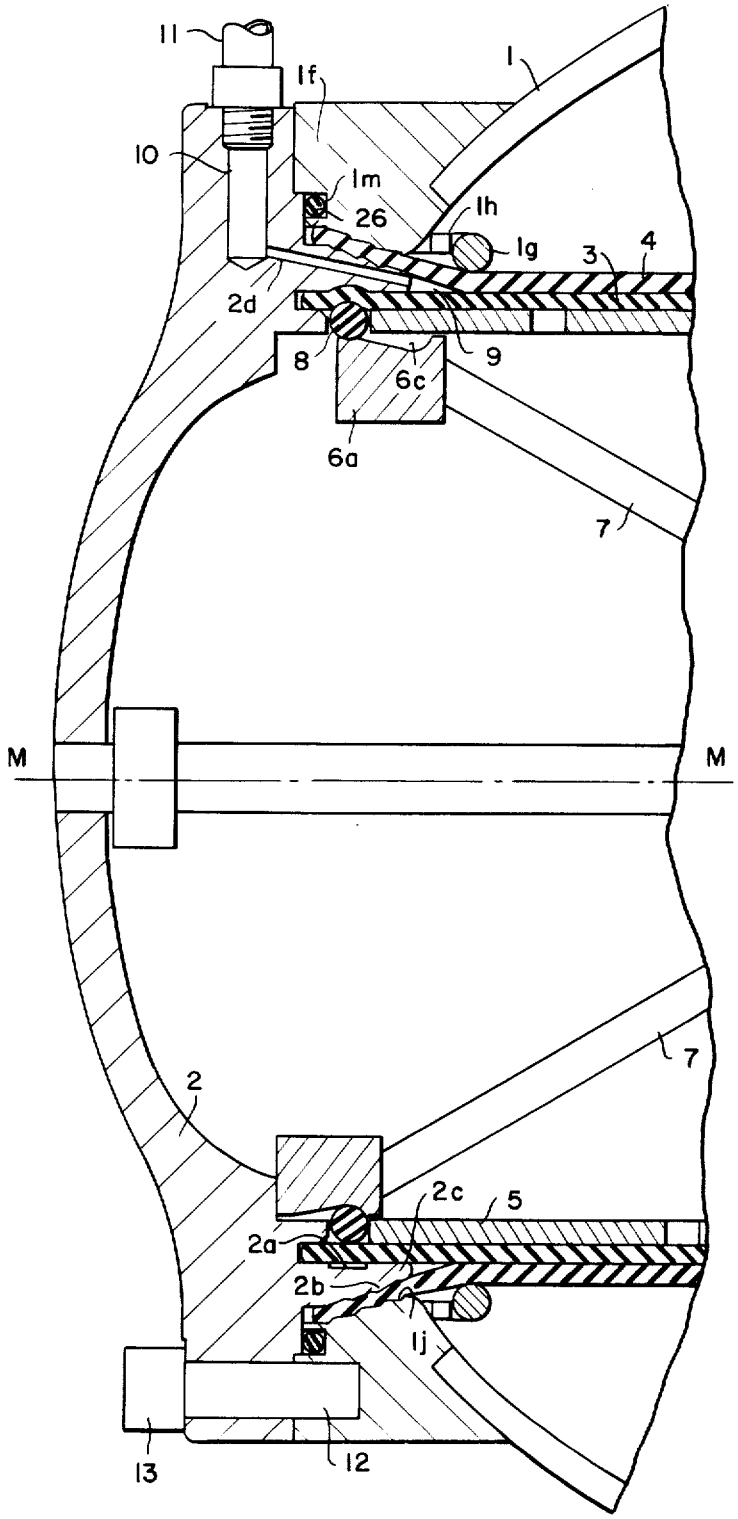
FIG. 4 depicts a central section through the spherical housing in the area of the left clamping point of the hose membrane.
Figure 4A:
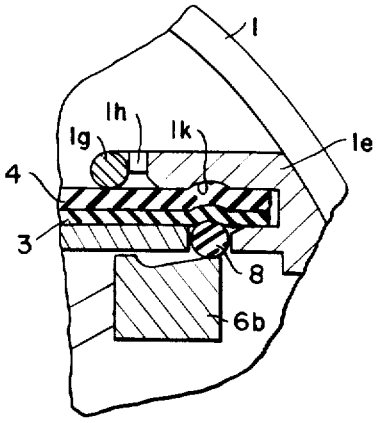

FIG. 4 illustrates the left-hand hose membrane clamping of the invention and the leakage indicator. The hose membranes 3,4 are shown clamped above the horizontally extending center line M—M, while the illustration underneath refers to their tension-free installation position. FIG. 4*a* shows the hose membrane clamping at the right hand side. While the right hand clamping is characterized by the feature that the divided or stretchable intermediate ring 8 of the hose membranes 3,4 presses these membranes together into the T-slot 1*k* of the rear acceptance ring 1*e*, the hose membranes 3,4 at the left side are fastened separately. The outer hose membrane 4 is fixed between the cover 2 and the housing flange 1*f*. The cover 2 as well as the housing flange 1*f* have a toothed clamping area 2*b* and 1*j*, respectively. The inner hose membrane 3 is pressed into the T-slot 2*a* of the cover 2 by way of the intermediate ring 8. The radial widening of the right- as well as the left-sided intermediate ring 8 is achieved by an axial displacement—to be described later on—of the rear or frontal, respectively, conical tension ring 6*b*, 6*a* which has a conical surface 6*c*. The bulging area of the hose membranes 3,4 is limited by the distance of the support ring 1*g* which, by means of a spacer ring 1*h* is connected with the housing flange 1*f* and the rear acceptance ring 1*e*, respectively.

Independent of the outer hose membrane 4 clamped between the housing flange 1*f* and the cover 2, the seal between the aforementioned housing components is effected by a housing seal 26 arranged within the slot 1*m*. In the case of a rupture of one of the two hose membranes 3 or 4, the cover tab 2*c* which divides the inner and the outer hose membranes 3,4 has a leakage bore 2*d* which connects the triangular annular gap 9 between the inner and the outer hose membranes 3,4 with a threaded opening 10, within the cover 2 to accept and remove leaking fluid. Inside of the threaded opening 10, there is a screw element with a hose spout 11. The rest of the identified parts have already been described or will be described in the following figures.

Figure 5:
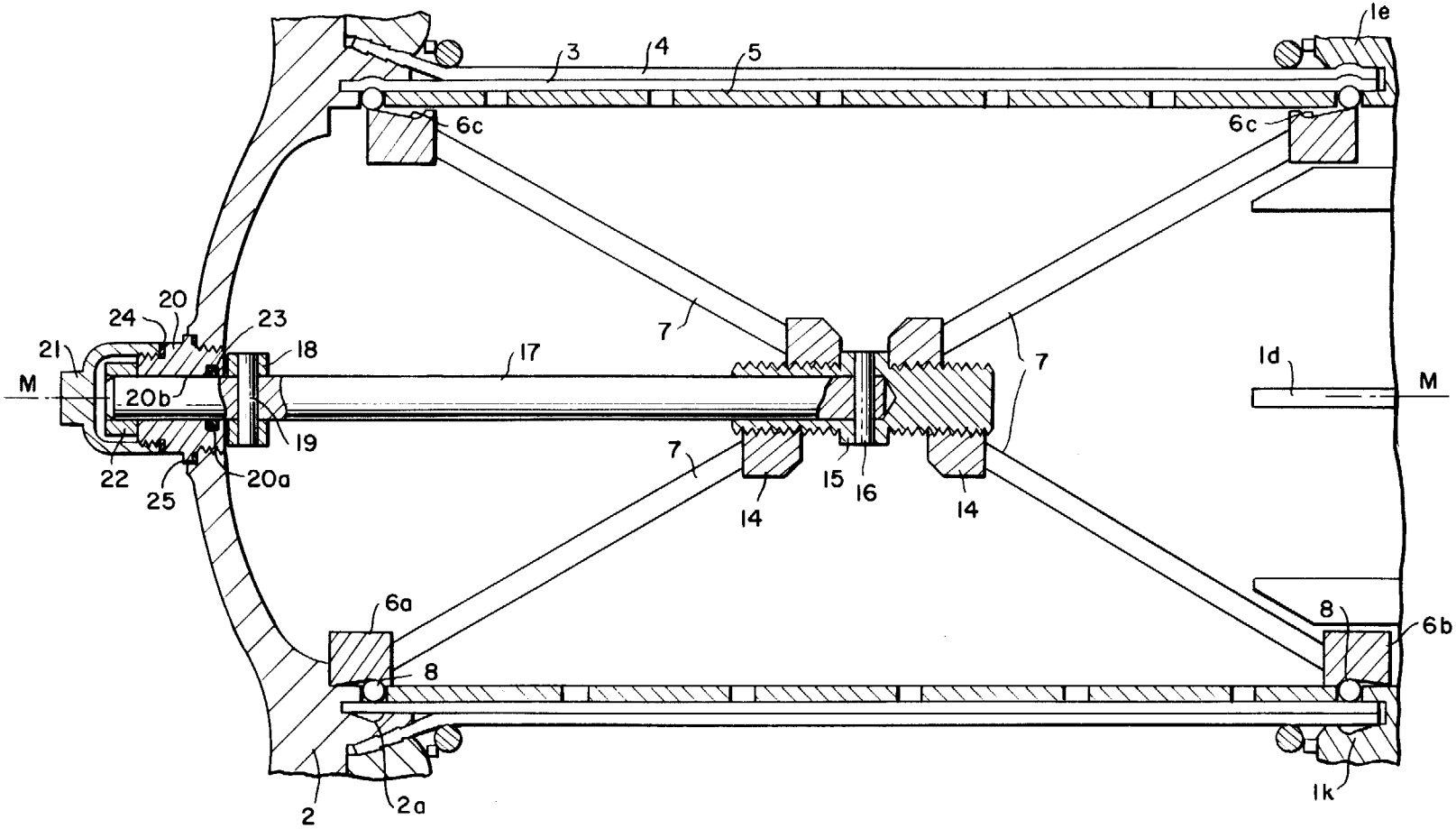
FIG. 5 shows a central sectional view taken through the spherical housing in the area of the device providing the clamping force to hold the hose membrane.

The axial tension, running in opposite directions, of the tension rings 6*a* or 6*b*, respectively, (FIG. 5) is effected by tension rods 7, each being in close material contact with tension rings 6*a* and 6*b* on the one hand and with an adjustment ring 14 on the other. One of the adjustment rings 14 has an interior left-handed thread, and the other has a right-handed interior thread. Both are located on a left-handed thread bolt and a right-handed thread bolt 15, arranged on the horizontal axis of the spherical housing within the area of the center of the spherical housing. Right above the horizontal central line M—M, the two adjustment rings 14 are shown in the position which they must assume whenever the hose membranes 3,4 are clamped in. Below the horizontal central line M—M the adjustment rings 14 are shown in the greatest possible distance from each other, permitting a tension free mounted position of the hose membranes 3,4 after their installation. The adjustment bolt 15 by way of the pin 16 is connected with the rod 17 which passes outward through the cover 2 and which is held and sealed within the bearing part 20. The seal of the rod 17 within the bearing bore 20*b* is performed by a sealing ring 23 arranged within the groove 20*a*. The rod 17 and the adjustment bolt 15 carried thereon with the adjustment rings 14 is, in addition, fixed axially within the bearing part 20, so that the tension rings 6*a*, 6*b* may be uniformly and simultaneously displaced in opposite directions. The axial fixation is performed by way of the inner and outer limiting ring 18 and 22, respectively. The inner limiting ring 18 is connected with the rod 17 by means of a pin 19, while the outer limiting ring 22 is connected with the rod 17 in close material contact, to state an example. The outer limiting ring 22 furthermore has either grooves or interlocking surfaces facilitating a twisting motion whenever the entire clamping device must be tightened or loosened. A protective cap 21 covers the outer limiting 22 in its entirety. Seals 24 and 25 prevent the operating liquid from escaping from the spherical housing.

Figure 6:
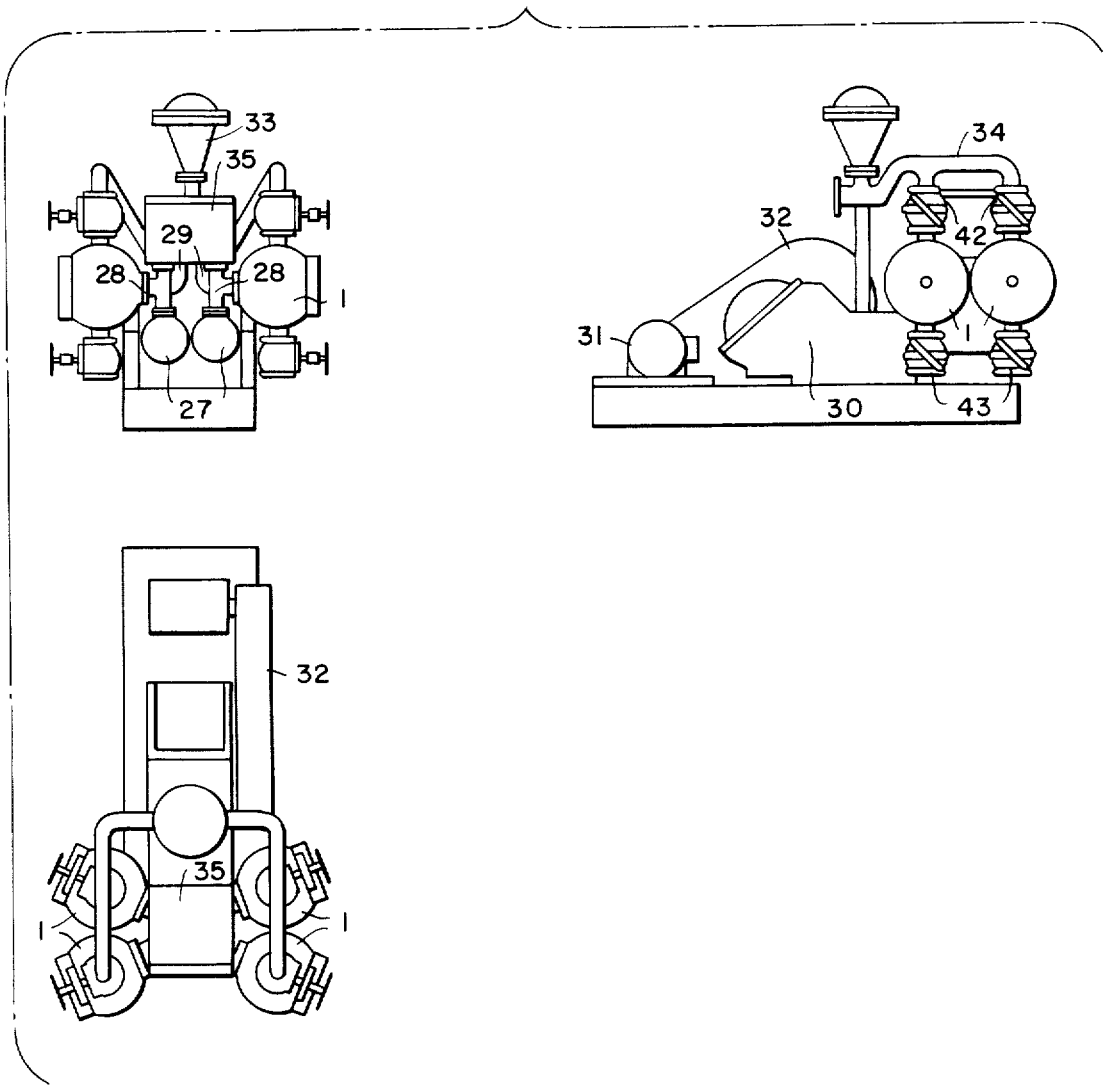
FIG. 6 shows a sketched overview of a pump unit according to the invention, with four spherical housings and two doubly operating service units.

FIG. 6 shows a schematic sketch of a pump unit with four spherical housings 1, arranged in an almost stellar constellation relative to the axis of the hose membranes 3,4 along a horizontal plane, two of them being alternatingly fed with primary operating medium by one each of the doubly acting service parts 27. Each of the spherical housings 1 by way of connecting fittings 28, having three connecting flanges and one connecting muff, is connected, first, by means of the lower connecting flange with one service unit 27, second, by way of the upper connecting flange with the storage container for the operating liquid 34, and third, with the lateral flange it is connected to the spherical housing 1 and by means of the lateral connecting muff it is connected with the safety line 29. The service units 27 are driven in a conventional manner by a motor 31 and a belt drive 32 and a gear mechanism 30. On the pressure side, two neighboring spherical housings 1 are connected with a pressure line 34 which ends in the wind tank 33. The spherical housings 1 each have one return valve 43, 42 on their suction side and on their pressure side.

Figure 7:
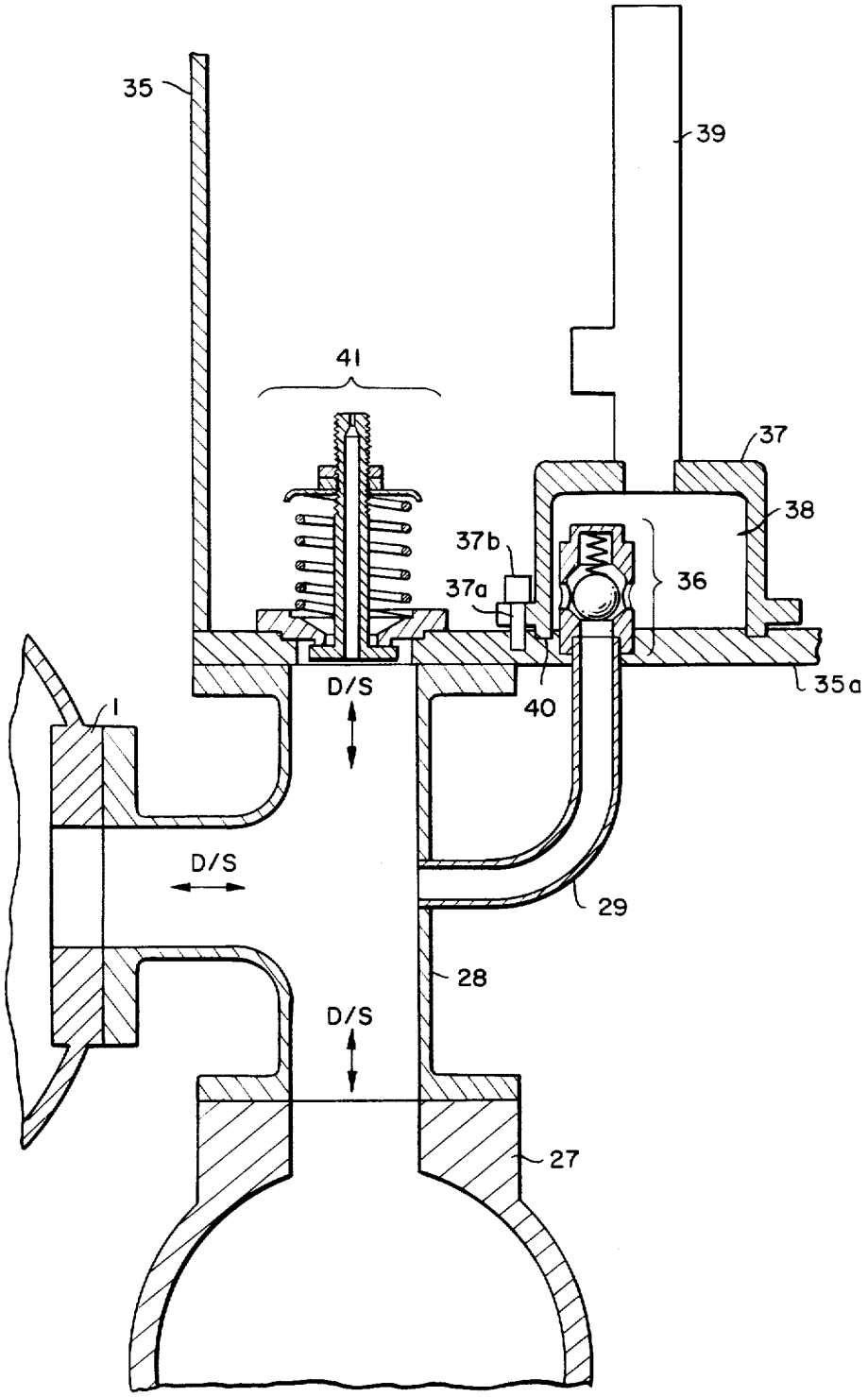
FIG. 7 shows a central section through the distributor fittings with adjacent components.

The connecting fittings 28 (FIG. 7), as mentioned in connection with FIG. 6, are provided with three connecting flanges which in turn are connected with the service unit 27, the spherical housing 1 and the floor of the storage container 35*a* and the fittings have also a connecting muff for the safety line 29. A loss- and regain valve 41 of conventional design and operating in a well known manner is arranged in the connecting opening between the connecting fittings 28 and the storage container for the operating liquid 35. During the pressure lift indicated at D of the primary operating medium, a certain amount of operating medium is pressed through the hollow-bore rod of the valve 41 which during the suction lift S is not available at first, creating a certain low pressure within the system, and, should the value fall below a limit which can be predetermined, briefly opening the automatic regain valve 41. According to the invention, each of the four connecting fittings 28 is connected, by means of a separate safety line 29, each ending in an automatic return valve 36 of conventional design, with the collecting tank 38, formed by the collecting bell 37 and the floor of the storage container 35. The collecting bell 37 at its frontal side is provided with a seal 40 and is pressed against the floor of the storage container 35*a* by means of connecting means 37*a*, 37*b*. One single safety valve 39 is arranged in the top of the collecting bell 37.

I claim:

1. A hydraulically-actuated, reciprocating diaphragm pump comprising:

inlet means defining a suction opening for receiving fluid to be pumped;

a spherical housing connected to said inlet means for receiving in a pumping chamber defined therein the fluid to be pumped;

an elongated cylindrical, tubular, generally hose-shaped membrane located in the interior of said spherical housing, said membrane being pulsed by pulsating pressure from a pressure source to pump said fluid being pumped through the pumping chamber of said spherical housing by expansion and contraction of said member when pulsed, said membrane being vertically, horizontally, and axially symmetrically disposed within said spherical housing to define the pumping chamber at the exterior thereof and inside of the spherical housing, said pumping chamber being symmetrically located between an inner surface of said membrane and the inner surface of said spherical housing, even when said membrane is pulsed, said membrane being clamped to said housing only at its opposite ends within said housing so that, during the pressure stroke of said pressure source, the tubular membrane is symmetrically deformed at points remote from its both clamped ends so that the points of greater distension of said membrane are remote from adjacent points of the interior of said spherical housing;

a support pipe within said membrane located so that said membrane closely surrounds said support pipe to prevent deformation of said membrane inwardly during the suction stroke of said pressure source, thus to avoid compressive strain on said membrane; and outlet means defining a discharge opening axially aligned with said suction opening and located opposite said suction opening on said spherical housing, said membrane comprising an inner cylindrical hose membrane and an outer cylindrical hose membrane provided about said support pipe, the outer membrane sheathing the inner membrane concentrically and without space between them, said pump being further characterized in that the inner and outer hose membranes at their rear ends are clamped together while the inner hose membrane at its frontal end is clamped in tight material contact between a rear acceptance ring and a cover at the outer side and a divided or radially stretchable ring at the inner side, a conical tension ring being axially movable toward the center of the spherical housing and arranged in a respective intermediate ring.

2. A diaphragm pump, designed as a hydraulically activated reciprocating pump, especially suited for the pumping of a viscous and abrasive secondary flowable medium or of one which is charged with solid material, with a pump section through which the secondary medium flows, the pump section being insertable as an integral part of a pipeline for the secondary medium to be pumped, having a return valve at each of the suction side and the pressure side of the pump section, and a service part designed as a separate unit coupled with the pump section by means of a connecting fitting for carrying a primary flowable operating medium, said primary medium affecting the inner surface of a tubular membrane made of elastomer material having the shape of a cylindrical hose and means for activating said hose by a pulsating pressure, the secondary medium being located within a pump chamber surrounding the membrane, said pump being characterized in that the pump chamber is formed by a spherical housing and the outer surface of the tubular membrane, said hose at its both ends being substantially symmetrically clamped within the spherical housing, and a support pipe, said membrane surrounding said support pipe to prevent deformation of said membrane inwardly toward said service part and thus to avoid compressive strain of said membrane, said pump being further characterized in that a support and an intermediate ring are arranged at an axial distance from each other, said distance being several times larger than the wall thickness of the hose membrane.

3. A diaphragm pump, designed as a hydraulically activated reciprocating pump, especially for the pumping of a viscous and abrasive flowable medium or of one which is charged with solid material, with a pump section through which the secondary medium flows, the pump section being insertable as an integral part of a pipeline for the secondary medium to be pumped, having a return valve at each of the suction side and the pressure side of the pump section, and having a service part designed as a separate unit coupled with the pump section by means of a separate unit coupled with the pump section by means of a connecting fitting for carrying a primary flowable operating medium, said primary medium affecting the inner surface of a tubular membrane made of elastomer material, having the shape of a cylindrical hose, means for activating said hose by a pulsating pressure, the secondary medium being located within a pump chamber surrounding the membrane, the improvement being characterized in that a plurality of spherical housings are provided, each containing either one or more than one hose membranes sheathing each other about a support pipe of circular cross section, and being clamped within said spherical housings with their respective ends, together forming one pump unit, said housings relative to the axis of the hose membranes being an almost stellar arrangement on a horizontal plane, two of which housings being alternately fed the primary operating medium by one of the double-acting service units, each of said plurality of housings being connected by a like plurality of connecting fittings connected with a collecting tank by way of a separate safety line, each having an automatic return valve, said collecting tank being formed by a collecting bell and the floor of a storage container, said collecting tank having a safety valve.

4. The diaphragm pump as claimed in claim 3, characterized in each of the spherical housings by a cover tab splitting the ends of the hose membranes and a leakage bore ending at the outer most edge of the cover tab, connecting it to a triangle annular gap between inner and outer hose membranes by way of a threaded opening.

5. The diaphragm pump as claimed in claim 4, characterized by each of the four connecting fittings being connected with a collecting tank by way of a separate safety line, each having an automatic return valve said collecting tank being formed by a collecting bell and the floor of a storage container, said collecting tank having one single safety valve.

6. The diaphragm pump as claimed in claim 3, characterized by the hose membrane arrangement or mode of clamping, respectively, in each of the spherical housings having inner and outer hose membranes clamped together at their rear ends between a rear acceptance ring and an intermediate divided or radially stretchable ring, while the inner hose membrane at its frontal end is clamped in tight material contact between a cover at the outer side and an intermediate divided or radially stretchable ring at the inner side, a conical tension ring being arranged in each intermediate ring, and being axially movable toward the center of the spherical housing.

7. The diaphragm pump as claimed in claim 6, characterized by each of the four connecting fittings being connected with a collecting tank by way of a separate safety line, each having an automatic return valve said collecting tank being formed by a collecting bell and the floor of a storage container, said collecting tank having one single safety valve.

8. The diaphragm pump as claimed in claim 6 characterized by a support and the intermediate ring being arranged at an axial distance from each other, said distance being several times larger than the wall thickness of the hose membrane or membranes.

9. The diaphragm pump as claimed in claim 8, characterized by each of the four connecting fittings being connected with a collecting tank by way of a separate safety line, each having an automatic return valve said collecting tank being formed by a collecting bell and the floor of a storage container, said collecting tank having one single safety valve.

10. The diaphragm pump as claimed in claim 6, characterized by each tension ring being connected, by means of tension rods with one of the adjustment rings on the axis of the housing in the area of the center of the spherical housing, one of the adjustment rings having a right-hand thread and the other having a left-hand thread, both being arranged on an adjustment bolt, said bolt having been arranged, by way of a rod passing through the cover being rotatable but immovable in the axial direction.

11. The diaphragm pump as claimed in claim 10, characterized by each of the four connecting fittings being connected with a collecting tank by way of a separate safety line, each having an automatic return valve said collecting tank being formed by a collecting bell and the floor of a storage container, said collecting tank having one single safety valve.

12. A diaphragm pump, designed as a hydraulically activated reciprocating pump, especially suited for the pumping of a viscous and abrasive secondary flowable medium or of one which is charged with solid material, with a pump section through which the secondary medium flows, the pump section being insertable as an integral part of a pipeline for the secondary medium to be pumped, having a return valve at each of the suction side and the pressure side of the pump section, and a service part designed as a separate unit coupled with the pump section by means of a connecting fitting for carrying a primary flowable operating medium, said primary medium affecting the inner surface of an elongated tubular membrane made of elastomer material having the shape of a cylindrical hose and means for activating said hose by a pulsating pressure, the secondary medium being located within a pump chamber surrounding the membrane, said pump being characterized in that the pump chamber is formed by the interior of a spherical housing and the outer surface of the tubular membrane, said hose at its both ends being substantially symmetrically clamped to position said hose both vertically and horizontally symmetrically within the spherical housing so that, during a pressure stroke, the tubular membrane is symmetrically deformed at points remote from its both ends so that points of greater distension of said membrane are clear from adjacent points of said spherical housing, and a support pipe, said membrane closely surrounding said support pipe to prevent deformation of said membrane inwardly toward said service part and thus to avoid compressive strain of said membrane, said membrane comprising an inner cylindrical hose membrane and an outer cylindrical hose membrane provided about said support pipe, the outer membrane sheathing the inner membrane concentrically and without space between them, said pump being further characterized in that the inner and outer hose membranes at their rear ends are clamped together while the inner hose membrane at its frontal end is clamped in tight material contact between a rear acceptance ring and a cover at the outer side and a divided or radially stretchable ring at the inner side, a conical tension ring being axially movable toward the center of the spherical housing and arranged in a respective intermediate ring.

13. The diaphragm pump as claimed in claim 12, characterized in that the hose membranes surround a modified support pipe and change and alter their shape, the said modified support pipe having, in each cross sectional vertical to the axis, several regularly shaped indentations substantially evenly distributed over the entire circumference, said indentations deepening increasingly from the ends of the support pipe toward the longitudinal middle, relative to the ability to change the shape of the hose membranes which shape is neutral to linear extension, said indentations being designed in such a manner that the length of the contour of the circumference of the modified support pipe at each point corresponds to the circumferential length of the non-modified support pipe.

14. The diaphragm pump as claimed in claim 13, characterized in that the circumferential length of the modified support pipe in each cross section vertical to the axis is equal to or greater than the considered circumferential length of the hose membranes immediately surrounding the support pipe.

15. The diaphragm pump as claimed in claim 14, characterized in that the outer contour of the modified support pipe in each cross section, vertical to the axis, consists of circular arcs of equal size, being arranged alternatingly convex and concave relative to the axis of the support pipe, having a diameter and common tangents at their points of transition

16. The diaphragm pump as claimed in claim 13, characterized in that the outer contour of the modified support pipe in each cross section, vertical to the axis, consists of circular arcs of equal size, being arranged alternatingly convex and concave relative to the axis of the support pipe, having a diameter and common tangents at their points of transition.

17. The diaphragm pump as claimed in one of claims 12, 13, 14, 16, 15, characterized by a cover tab splitting the ends of the hose membranes and a leakage bore ending at the outermost edge of the cover tab, connecting it to a triangular annular gap between said inner and outer hose membranes by way of a threaded opening.

18. The diaphragm pump as claimed in one of claims 12 or 13 16 or 15, characterized by a support and the intermediate ring being arranged at an axial distance from each other, said distance being several times larger than the wall thickness of the hose membranes.

19. The diaphragm pump as claimed in claim 8, characterized by a cover tab splitting the ends of the hose membranes and a leakage bore ending at the outermost edge of the cover tab, connecting it to a triangle annular gap between inner and outer hose membranes by way of a threaded opening.

20. The diaphragm pump as claimed in claim 12, characterized by a cover tab splitting the ends of the hose membranes and a leakage bore ending at the outermost edge of the cover tab, connecting it to a triangle annular gap between inner and outer hose membranes by way of a threaded opening.

21. The diaphragm pump as claimed in claim 12, characterized by each tension ring being connected, by means of tension rods with one of the adjustment rings on the axis of the housing in the area of the center of the spherical housing, one of the adjustment rings having a right-hand thread and the other having a left-hand thread, both being arranged on an adjustment bolt, said bolt having been arranged, by way of a rod, passing through the cover to be rotatable but immovable in the axial direction.

22. The diaphragm pump as claimed in claim 21, characterized by a cover tab splitting the ends of the hose membranes and a leakage bore ending at the outermost edge of the cover tab, connecting it to a triangle annular gap between inner and outer hose membranes by way of a threaded opening.

* * * * *

UNITED STATES PATENT AND TRADEMARK OFFICE

CERTIFICATE OF CORRECTION

PATENT NO. : 4,492,535

DATED : January 8, 1985

INVENTOR(S) : Friedrich R.R. Stahlkopf

It is certified that error appears in the above-identified patent and that said Letters Patent is hereby corrected as shown below:

Column 1, line 51, -- the -- should be inserted before "thus";

Column 2, line 40, "abrasive" should be deleted;

Column 7, between lines 30 and 31, the following sentence as a separate paragraph should be inserted:

-- In the drawings: --;

Column 8, line 41, "ring" should be -- rings --;

Column 9, line 53, "$\Delta$" should read -- $\varepsilon$ --;

Column 11, line 40, "34" should be -- 35 --;

Column 16, line 14 (claim 17, line 2), "16, 15" should be -- 16 or 15 --; and

Column 16, line 20 (claim 18, line 2), "13 16" should be -- 13 to 16 --.

Signed and Sealed this

*Twenty-third* Day of *July 1985*

[SEAL]

*Attest:*

DONALD J. QUIGG

*Attesting Officer* *Acting Commissioner of Patents and Trademarks*